United States Patent [19]

Berger

[11] 4,170,123

[45] Oct. 9, 1979

[54] CONVERTIBLE MULTIPLE BLOW TWO DIE COLD HEADER

[75] Inventor: James R. Berger, Tiffin, Ohio

[73] Assignee: The National Machinery Company, Tiffin, Ohio

[21] Appl. No.: 874,885

[22] Filed: Feb. 3, 1978

[51] Int. Cl.[2] ..... B21D 22/00; B21K 1/44

[52] U.S. Cl. ..... 72/356; 10/12 T; 10/12.5; 10/13; 10/15

[58] Field of Search ..... 10/11 R, 12 R, 12 T, 10/12.5, 15, 13; 72/356

[56] References Cited

U.S. PATENT DOCUMENTS

| | | | |
|---|---|---|---|
| 2,303,780 | 12/1942 | Wilcox | 10/12.5 |
| 2,599,053 | 6/1952 | Friedman | 10/12.5 |
| 2,721,343 | 10/1955 | Friedman | 10/12 T |
| 2,768,394 | 10/1956 | Ward | 10/13 |
| 3,264,664 | 8/1966 | Prulton | 10/12 T |
| 3,604,242 | 9/1971 | Alleback | 10/12 T X |
| 3,755,839 | 9/1973 | Enody | 10/15 X |

*Primary Examiner*—Leon Gilden

*Attorney, Agent, or Firm*—Pearne, Gordon. Sessions, McCoy & Granger

[57] ABSTRACT

A multiple blow, two die metal forming machine having a drive system which is capable, without alteration, of conversion in operational mode between two blows at the first die, one blow at the second die and one blow at the first die, two blows at the second die. The various workpiece transferring elements and ejecting members are activated by the drive system in respective fixed cycles which are compatible with operation in both operational modes. Operations at the second die station are out of phase with those of the first die station by one stroke thereby allowing the transfer of workpieces between the first and second dies to occur over a relatively long period for a reduction of transfer speed and an increase in transfer reliability.

14 Claims, 5 Drawing Figures

CONVERTIBLE MULTIPLE BLOW TWO DIE COLD HEADER

BACKGROUND OF THE INVENTION

The invention relates to metal forming machines and, in particular, to a type of forging or heading machine capable of striking multiple blows at each of a plurality of die stations.

Multiple blow forging machines are characterized by their high operational speeds and productivity resulting from the avoidance of workpiece transferring steps between working blows. Multiple die heading machines are utilized for making parts requiring a plurality of successive forming steps in different die cavities. Certain machines have been developed to combine the benefits of both multiple blow machines with those of multiple die machines. The prior art has included three blow two die headers and to limited extent machines of this general type capable of conversion between two blows on a first die, one on a second die and one blow on the first die, two on the second die. Such convertible machines known in the prior art have required extensive set-up changes in their drive systems for conversion between operational modes. These involved set-up procedures are inherently time consuming and are susceptible to errors or omission which in turn may require subsequent adjustment, result in production of unnecessary waste and consequent lost production and damage to the machine or tooling.

SUMMARY OF THE INVENTION

The invention provides a multiple blow, multiple die metal forming machine capable of being selectively operated in either of two modes without modification of its various drive components. The disclosed machine is, besides being flexible in operation by virtue of its dual mode capability, readily converted from one mode to the other without extensive set-up time and risk of improper assembly or adjustment of the drive system.

Thus, besides affording a high degree of versatility in operation characteristic of convertible machines, the disclosed machine is adapted to be converted from one operational mode to the other with a minimum of effort and skill. As a result, during conversion an operator is enabled to concentrate on adjustments more directly related to the actual forming of different parts primarily in connection with the setting of new tooling. It is recognized that a convertible machine is capable of producing a greater variety of parts by performing various forming steps optionally at either die station with modified or completely new tooling designs.

The disclosed machine, having two die stations, is convertible in operational mode between one blow on the first die, two on the second die and two blows on the first die, one on the second die. Consonant with conventional practice, workpieces are mechanically transferred to the first die and from the first die to the second die by elements in the form of mechanical fingers and are kicked out or ejected from the die stations by suitable mechanical elements. In accordance with the invention the transferring and ejecting elements are operated by drive elements timed with operation of the heading slide in a manner wherein ejection and transfer from a die station are initiated only after two strokes of the heading slide, either two working strokes or one working stroke and one idle stroke. This two stroke delay of ejection and transfer timing at each die station is thereby compatible with operation in either operational mode since sufficient time is provided in each die station to perform two potential working blows. Moreover, in accordance with the invention, the ejection and transfer drive elements are timed to maintain a one stroke phase difference between the die stations such that the first working stroke at the second die station is simultaneous with the second potential working stroke at the first die station. This staggered working stroke cycle allows workpieces transferred from the first die station to the second die station to be delayed through one stroke of the slide so that a greater period of time is available for transfer movement and average transfer speed is greatly reduced for reliability of operation.

DESCRIPTION OF THE PREFERRED EMBODIMENT

Figure 1:
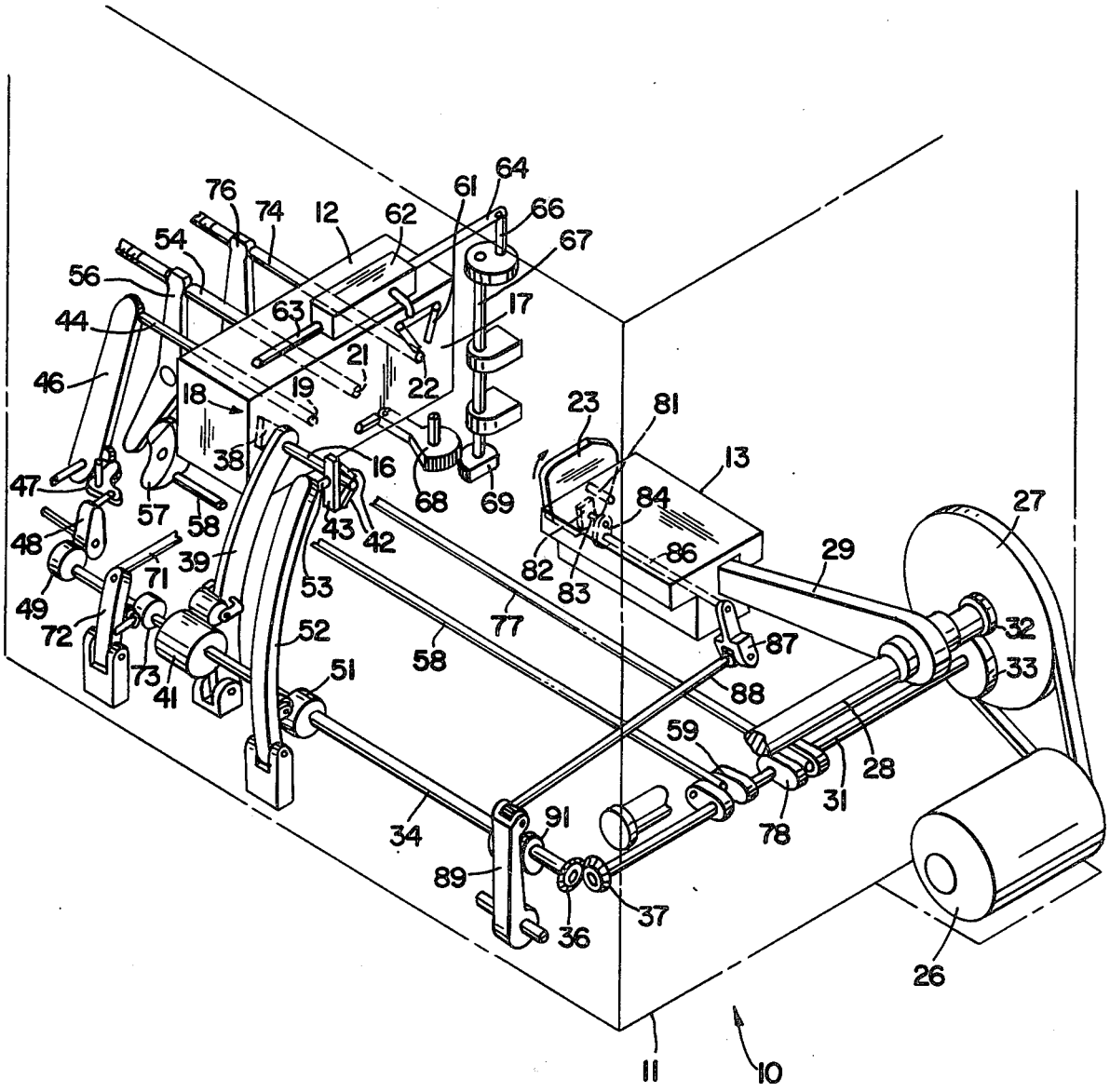
FIG. 1 is a schematic perspective view of certain operative elements and an associated drive system in a metal forming machine embodying the principles of the invention.

Referring now to the drawings and in particular to FIG. 1 there is shown a machine 10 having a frame diagrammatically represented at 11 on which is stationarily mounted a die block 12. A heading slide 13 is mounted on the frame 11 by suitable bearings for reciprocation in a direction towards and away from the die block 12. In a generally conventional manner workpieces or blanks 16 cut from bar or coil stock are transferred in a direction parallel to the face, designated 17, of the die block 12 successively between a cut-off station 18, a pusher 19, and first and second die stations 21 and 22 respectively. At the die stations 21 and 22 workpieces are progressively headed by tools mounted on a punch rocker or plate 23 shiftably carried on the heading slide 13.

The drive system for the various elements of the machine 10 is powered by a suitable electric motor 26 driving a flywheel 27 in rotation. The flywheel 27 is drivingly connected to an eccentric shaft 28 suitably journaled on the frame 11. The eccentric shaft 28 develops reciprocation of the heading slide 13 through a pitman 29. A cross shaft 31 is driven at one half the rotational speed of the eccentric shaft 28 by timing gears 32,33. A cam shaft 34, in turn, is rotated by the cross shaft 31 through bevel gears 36,37 at a speed the same as that of the cross shaft. Bar stock fed by conventional means is sheared between a cut-off quill 38 and a cutter arm 39 when the cut-off arm is driven by a cam 41 on the cam shaft 34 from the quill to the pick-up station or pusher 19. The workpiece 16 is moved into a pair of fingers 42 of a first transfer device 43 at the pick-up station 19 by a pusher rod 44 operated by a series of levers 46, 47, and 48 driven by a cam 49 on the cam shaft 34.

The first transfer device 43 operates to move the workpiece 16 from the pick-up station 19 across the die face 17 to the first die station 21. The first transfer 43 is driven by a cam 51 on the shaft 34 followed by a lever 52 which causes horizontal displacement of a rod 53 supporting the transfer fingers 42 for horizontal rectilinear movement.

After the work piece 16 is suitably worked at the first die station 21 it is ejected or kicked out therefrom by a pin 54 driven by a kick out lever 56 operated through a second lever 57 and in turn operated by an elongated rod 58 connected at its opposite end to a crank 59 on the cross shaft 31. The kick out pin 54 moves the workpiece 16 into the fingers, designated 61, of a second transfer device 62. Upon receiving control of the workpiece 16 at a position directly in front of the first die station 21 the second transfer 62 commences to move parallel to the die face 17 towards the second die station 22 and ultimately to the position illustrated in FIG. 1. The second transfer 62 is driven horizontally on a guide shaft 63 by a connecting rod 64 joined to an eccentric 66 supported on a vertical shaft 67. The shaft 67 is oscillated in time relation to rotation of the cam shaft 34 by intermeshed gear segments 68, 69 operated by a generally horizontal rod 71 connected at one end to pivot one of the gear segments 68 and at the other end to a lever 72 following an associated cam 73 on the shaft 34.

Figure 4:
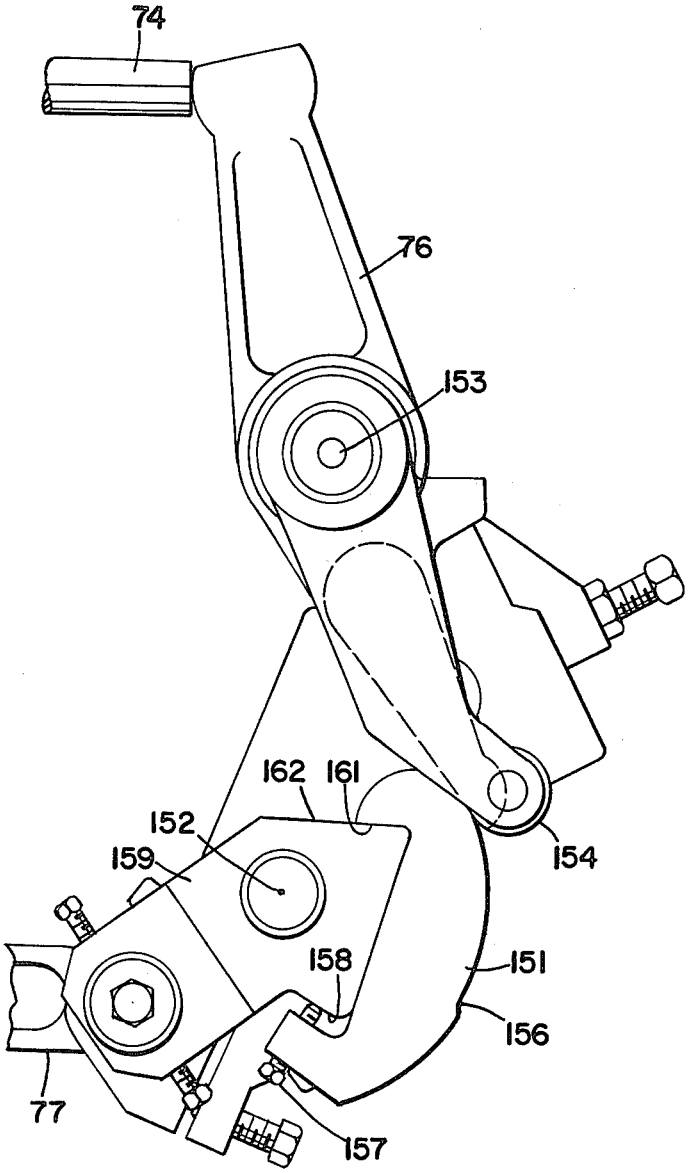
FIG. 4 is a side view of a kick-out lever associated with the second die and related elements.

Upon suitable working at the second die station 22 a completed work piece is ejected or kicked out of the second die station by a pin 74 operated by a kick out lever 76. The kick out lever 76 is driven by a secondary lever (FIG. 4) under control of a connecting rod 77 having its opposite end joined to a crank 78 on the cross shaft 31. As shown, the first and second kick out cranks 59, 78 are offset approximately 180 degrees from one another.

The punch rocker or tool carrying plate 23 is pivotally supported on the heading slide 13 by a shaft 81 for oscillation in a plane perpendicular to the direction of slide movement. The punch rocker 23 is shifted between two working positions, discussed below, by a slider block 82 disposed in a suitable slot in the body of the punch rocker. The slider block 82 embraces a pin 83 on a short lever or crank 84 which oscillates with a shaft 86 journaled on the heading slide 13. A lever 87 fixed to the shaft 86 is rocked by a connecting rod 88. The connecting rod 88 has one of its ends universally connected to the lever 87 and its other end universally connected to a lever 89 following a cam 91 on the shaft 34.

Figure 2:
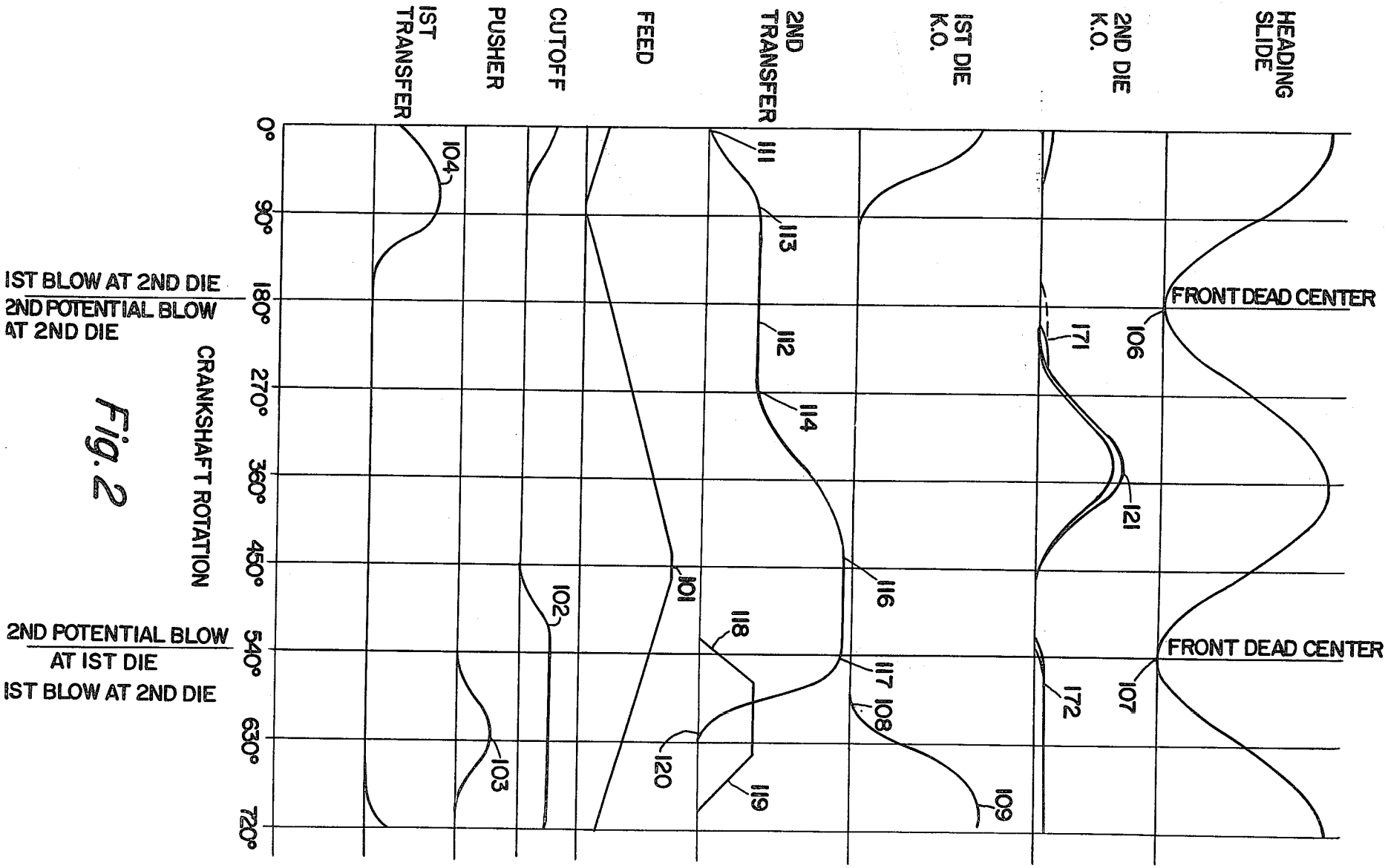
FIG. 2 is a timing diagram depicting a relationship of displacements of certain elements of the machine developed by the drive system of FIG. 1.
Figure 3A:
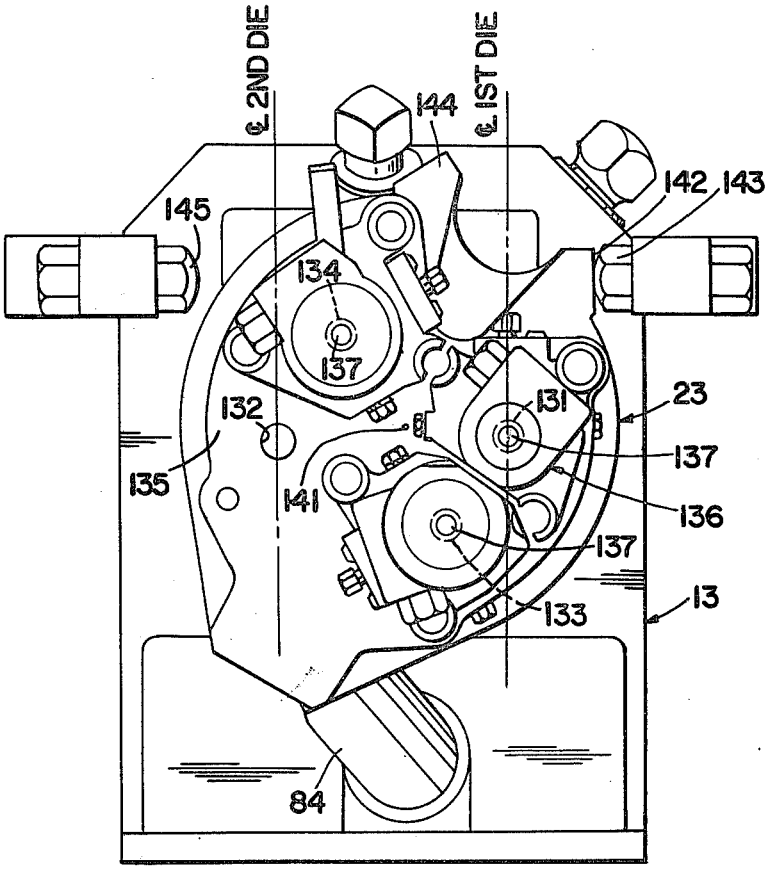
FIG. 3*a* is a view, looking away from the dies, of a shiftable punch rocker carried on the header slide supporting tools in a configuration suitable for performing two working strokes at the first die station and one working stroke at the second die station.

The above described drive elements are constructed and arranged by way of suitable cam profiles and other geometric measures to produce the kinematics represented in FIG. 2. It will be appreciated that these kinematics remain essentially unchanged regardless of which of two operational modes the machine is set-up to follow. As previously indicated, these operational modes include two blows on the first die 21, one blow on the second die 22 as represented by FIG. 3*a* and one blow on the first die 21 and two blows on the second die corresponding to FIG. 3*b*.

Referring to FIG. 2, wire stock is fed through the cut-off quill 38 (FIG. 1) to a point designated 101 in the "feed" area of the diagram. Thereafter at point 102 material is cut off from the supply stock, transferred to the pick-up or pusher station 19 and moved into the first transfer at a point designated 103 in the "pusher" area of the diagram of FIG. 2. Thereafter, the first transfer 43 transfers the workpiece 16 to the first die station 21 at a point on the diagram designated 104. Shortly thereafter at a point designated 106 the heading slide reaches front dead center to perform the first blow on the workpiece 16 at the first die station 21. The workpiece remains in the first die station 21 until after the header slide retracts and then again reaches front dead center at a point 107 on the diagram during a second stroke which is either a working blow or an idle stroke and is thereafter kicked out of the first die during a period beginning at a point 108 on the timing diagram.

When the first die kick out pin 54 is fully extended at a point 109 the workpiece is under control of the second transfer 62 which begins moving from the first die at a point 111 to an area between the first and second dies 21 and 22 indicated on the diagram at 112. Inspection of this diagram area depicting movement of the second transfer 62 reveals that the second transfer is essentially motionless for a time period beginning at a point 113 substantially before front dead center and ending at a point 114 substantially after front dead center of the heading slide as the slide performs the first blow on the subsequent workpiece at the first die station. After the point 114 the second transfer again starts up on its path to the second die station 22. The second transfer reaches the second die station at a point 116 and dwells at this station to a point 117 roughly corresponding to front dead center of the heading slide at 540 degrees of crank shaft rotation at which point the heading slide is performing the first blow at the second die station. A line 118 represents the timing of finger opening on the second transfer 62 while line 119 represents closing of these second transfer fingers. From the point indicated at 117, the second transfer returns from the second die station 22 to the first die station 21 at a point indicated at 120. The workpiece remains in the second die station from the point 116 of its delivery by the second transfer through the immediately following forward stroke of the heading slide corresponding to the first blow on the workpiece at this second die through the next subsequent forward stroke of the heading slide, either a working stroke or an idle stroke, and is thereafter ejected from the second die 22 by the second die kick out at a point 121.

Restating the above discussion in other words, the first and second die kick out pins are timed to be effective only after two strokes of the heading slide at their respective die stations 21 and 22. Similarly, the first and second transfers 53 and 62 operate on individual cycles each of which extends over two cycles or blows of the heading slide. That is, the first transfer only moves after two blows of the heading slide at the first die station and the second transfer leaves the second die station, goes to the first station, and then returns to the second die station only after two strokes of the heading slide. It is to be noted that the first blow on a workpiece at the second die occurs simultaneously with the second blow on a subsequent workpiece at the first die station. That is, the first blow at the first die station and the first blow at the second die station are out of phase by one stroke of the heading slide.

Referring to FIGS. 3*a* and *b* the punch rocker plate 23 is provided with four pilot hole centers 131–134 into which various tool or punch holders each generally designated by the numeral 136 are selectively registered. The pilot hole centers 131–134 are formed in a face 135 of the punch rocker 23 which confronts the die face 17. Each of the punch holders 136 carries a tool or punch indicated schematically at 137. Each pilot hole center of opposed pairs 131, 132 on the one hand and 133, 134 on the other have a spacing equal to and in alignment with the spacing between the first and second die stations 21, 22 as suggested by the vertical center lines depicted in FIGS. 3*a* and *b*. The punch rocker 23 oscillates about a center indicated at 141 which is slightly above the vertical height of the first and second die station centers 21, 22. The limits of travel of the punch rocker 23 are determined by a surface 142 on an upper side face of the punch rocker in abutment with the head 142 of an adjacent stop screw and, alternatively, an opposite side surface 144 in similar abutment with a stop screw head 145.

The mode of operation of the machine 10 in performing one or two blows at a particular die station is determined by the selected arrangement of punch holders and punches 136, 137 assembled on the face 135 of the punch rocker 23. Accordingly, the arrangement of FIG. 3*a* produces two successive blows on a workpiece at the first die and only one blow on a work piece at the second die since there is no punch associated with one of the pilot hole centers 132 which registers with the second die. From the above description it will be understood that in the showing of FIG. 3*a* the heading slide is in a condition to perform a first blow on a workpiece in the first die (by the tool registered with the pilot hole 131) and simultaneously perform an idle stroke at the second die (pilot hole 132). With the punch rocker turned counterclockwise as viewed in FIG. 3*a* to its alternate position the heading slide is in a condition to perform the second blow on a first die (by the tool registered with the pilot hole 133) and simultaneously the first blow on a second die (by the tool registered with the pilot hole 134).

Figure 3B:
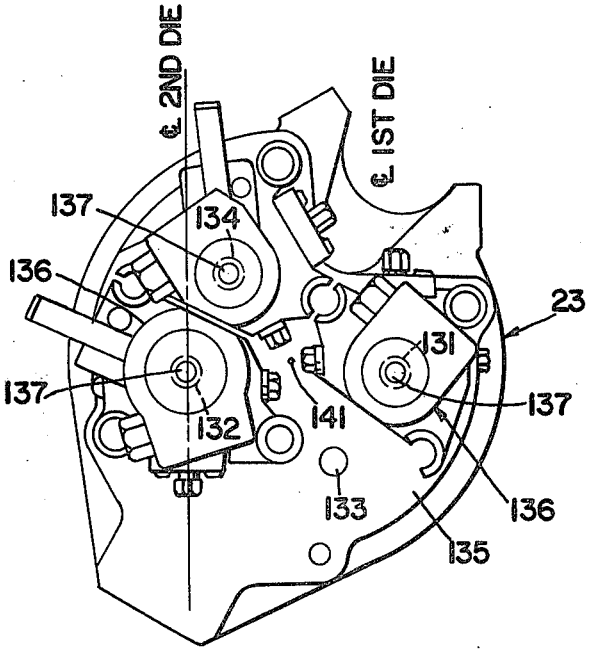
FIG. 3*b* is a view, similar to FIG. 3*a* illustrating tools in a configuration suitable for performing one working stroke at the first die station and two working strokes at the second die station.

The arrangement of tools 137 in FIG. 3*b* corresponds to the operational mode of two blows on a workpiece at the second die and only one blow on a workpiece at the first die. This follows from the absence of a tool at the pilot hole center 133 associated with the first die station when the punch rocker 23 is in an alternate position from that shown in FIG. 3*b*. In both operational modes the punch rocker 23 supports the tool holders 136 which are inactive during any particular stroke at points which are clear of interference with the die stations.

The sequence of blows at the first and second die stations is altered by the presence or absence of tools on certain pilot hole centers 131–134. However, it is to be noted that the sequence of movement of the first and second transfer devices 43,62 as well as the action of the kick out pins 54, 74 is identical between both operational modes. The second transfer 22 rests in a position intermediate the first and second dies, at a point which does not interfere with any of the idle punches on the punch rocker. This intermediate idle position corresponds to the dwell period between points 113 and 114 in FIG. 2. It will be understood that while the second transfer rests in this idle position it is supporting a partially formed workpiece so that there are actually three workpieces in progress since separate workpieces are simultaneously being formed at the first and second die stations.

Where a workpiece is to be trimmed or similarly finished such operation occurs in the last working blow at the second die station. Since with the disclosed machine there are either one or two working blows performed at the second die station there is provided cam means 151 illustrated in FIG. 4 constructed and arranged to produce suitable partial displacement of the second die kick out pin 74 to selectively provide a trim function alternatively on either the first or second heading strokes at the second die station. The cam means 151 is oscillated about a pivot center 152 under the influence of connecting rod 77 (FIGS. 4 and 1) in turn driven by the cross shaft 31. The second die station kick out lever 76 oscillates about a point 153 by following the profile of the cam means 151 through an associated cam follower roller 154. A cam rise area 156 of the cam 151 causes sufficient displacement of the kick out pin 74 to provide adequate trimming. The cam means 151 is shaped in a fashion of a C-clamp and includes a clamping screw 157 which engages a surface 158 of a holder 159 pivoting on the center 152. A surface 161 on the cam means 151 opposite the screw 157 engages a corresponding surface 162 of the holder 159.

The cam means 151 is reversible on the holder 159 such that the clamping bolt 157 can be disposed on the surface 162 while the cam means surface 161 abuts the lower holder surface 158. In the orientation of the cam means shown in FIG. 4 the cam rise 156 generates trimming movement, designated generally at 171 on the timing diagram near the 180 degree mark of FIG. 2. In the position reversed from that shown in FIG. 4 the cam rise surface 156 generates the trimming motion indicated generally at 172 at the 540 degree mark in the diagram. Trimming motion at the point 172 corresponds to the operational mode of the machine wherein two blows are performed on the first die station and only one blow is performed at the second die station while the point 171 corresponds to trimming when the machine is operating in the alternative mode with one heading blow at the first die station and two heading blows at the second die station. It can be noted that where trimming occurs at the point 172 on the timing diagram, that is, where only one blow is performed at the second die, there is no immediate kick out of the workpiece but rather kick out is delayed through another heading stroke and the point 121 is reached in the timing diagram.

Although a preferred embodiment of this invention is illustrated, it should be understood that various modifications and rearrangements of parts may be resorted to without departing from the scope of the invention disclosed and claimed herein.

I claim:

1. A metal forming machine comprising a frame, a die block mounted on the frame, a slide reciprocably mounted on the frame along a line of movement towards and away from the die block and adapted to carry tools thereon, the die block having first and second die stations spaced from each other along a direction perpendicular to the slide line of movement, means including drive means for transferring a workpiece from the first die station to the second die station in timed relationship to movement of the slide, means for cyclically shifting the position of tools on the slide in timed relationship to the movement of the slide, the drive means of said transfer means being constructed and arranged to permit tools carried in one selected pattern on the slide to operate selectively on a single workpiece once and with tools carried on the slide in another selected pattern a greater predetermined number of times at the first die station, and with the same construction and arrangement selectively on a single workpiece once with a suitable pattern of tools carried on the slide and said greater predetermined number of times with a pattern of tools different from said suitable pattern at the second die station.

2. A machine as set forth in claim 1, including means for transferring a new workpiece to said first die station and means for ejecting workpieces from both of said die stations, said last-mentioned transfer means and said ejecting means being constructed and arranged to permit tools on the slide to operate selectively on a single workpiece one or said greater predetermined number of times at the first die station and, with the same construction and arrangement, selectively on a single workpiece one or said greater predetermined number of times at said second die station.

3. A metal forming machine comprising a frame, a die block mounted on the frame, a slide reciprocably mounted on the frame along a line of movement towards and away from the die block and adapted to carry tools thereon, the die block having first and second die stations spaced from each other along a direction perpendicular to the slide line of movement, first transfer means including drive means for transferring a new workpiece to said first die station and second transfer means including drive means for transferring a partially formed workpiece from the first die station to the second die station in timed relationship to movement of the slide, means for ejecting workpieces from both of said die stations, means for cyclically shifting the position of tools on the slide in timed relationship to the movement of the slide, both of said transfer means and said ejection means being constructed and arranged to permit machine operation with forming by tools carried on the slide of workpieces at said two die stations in either of two modes at said two die stations without change of such construction and arrangement, one of said modes comprising two blows on a first die, one blow on a second die and in the other mode one blow on the first die, two blows on the second die.

4. A machine as set forth in claim 3, wherein both of said transfer means and said ejection means are constructed and arranged to eject a workpiece and introduce a subsequent workpiece at each die station after two successive strokes of the slide.

5. A machine as set forth in claim 4, wherein both of said transfer means and said ejection means are constructed and arranged to cause the first working blow on a workpiece at the second die station to occur simultaneously with the stroke of the slide immediately following the first working blow at the first die station.

6. A metal forming machine comprising a frame, a die block including first and second die stations mounted on the frame, a slide reciprocable on said frame, drive means for cyclically moving said slide towards and away from said die block, means for ejecting workpieces from said first and second die stations, means for transferring new workpieces to the first die station and partially formed workpieces ejected from the first die station to the second die station, a tool carrier mounted on the slide and shiftable thereon between first and second working positions, said tool carrier being adapted to support at least one tool in alignment with one of said first and second die stations when in one working position and a pair of different tools each in alignment with a separate one of said die stations when in the other working position, said ejecting means and transfer means both being constructed and arranged to operate, in timed relationship to movement of said slide, on a workpiece at the first die station only after two forward strokes including at least one tool working stroke of the slide subsequent to arrival of such workpiece at the first die station and on a workpiece at said second die station only after two forward strokes including at least one tool working stroke of the slide subsequent to arrival of such workpiece at said second die station whereby the number of working strokes at either of said die stations may be altered between one or two without requiring change of the timed relationship of said transferring and ejecting means with said slide.

7. A forming machine as set forth in claim 6, wherein said ejecting and transfer means are constructed and arranged to cause the first tool working stroke on a workpiece at the second die station to occur simultaneously with the stroke of the slide immediately following its first tool working stroke at the first die station.

8. A metal forming machine comprising a frame, a die block including first and second die stations mounted on said frame, a slide reciprocable on said frame, drive means for cyclically moving said slide toward and away from said die block, means for ejecting workpieces from said first and second die stations, first means for transferring new workpieces to the first die station and second means for transferring partially formed workpieces ejected from the first die station to the second die station, said second transfer means including drive means arranged to condition said second transfer means to receive a workpiece partially formed at said first die station after a forward stroke of said slide, said transfer drive means being arranged to cause said second transfer means to move to and support said partially formed workpiece at a position intermediate said first and second die stations during the first subsequent forward stroke of said slide following said forward stroke and thereafter carry said partially formed blank to said second die station prior to the second subsequent forward stroke of said slide whereby said second transfer means is arranged to operate at a relatively low speed in traveling with a workpiece between said first and second die stations.

9. A metal forming machine as set forth in claim 8, wherein said slide includes a tool carrier shiftable between two alternate positions, said tool carrier having provision for mounting tools thereon in registration with at least one of said first and second dies in both of its positions.

10. A metal forming machine as set forth in claim 9, wherein said ejecting means, said first transfer means, and said second transfer means are constructed and arranged to permit said machine to operate in either of two modes corresponding to two tool working strokes at the first die, one tool working stroke at the second die and one tool working stroke at the first die, two tool working strokes at the second die with selection between such modes being determined by the arrangement of tools on said tool carrier.

11. A metal forming machine comprising a frame, a die block including first and second die stations mounted on the frame, a slide reciprocable on said frame, drive means for cyclically moving said slide towards and away from said die block, means for ejecting workpieces from said first and second die stations, means for transferring new workpieces to the first die station and partially formed workpieces ejected from the first die station to the second die station, a tool carrier mounted on the slide and shiftable thereon between first and second working positions, means for shifting the tool carrier between the alternate first and second working positions on successive strokes of the slide, said tool carrier including means to support each of a pair of tools in alignment with a separate one of said die stations when in one working position and each of a second pair of tools in alignment with a separate one of said die stations when in the other working position, the arrangement of said tool carrier being such that an inactive pair of tools during a stroke of the slide are supported at points clear of said first and second die stations.

12. A metal forming machine as set forth in claim 11, wherein said ejecting means and transfer means are both constructed and arranged to operate, in timed relationship to movement of said slide, on a workpiece at the first die station only after two forward strokes of the slide subsequent to arrival of such workpiece at the first die station and on a workpiece at said second die station only after two forward strokes of the slide subsequent to arrival of such workpiece at said second die station, the number of working strokes at either of said die stations being altered between one or two by arranging a corresponding number of associated tools on the carrier without requiring change of the timed relationship of said transfer and ejecting means with said slide.

13. A metal forming machine comprising a frame, a die block including first and second die stations mounted on the frame, a slide reciprocable on said frame, drive means for cyclically moving said slide towards and away from said die block, means for ejecting workpieces from said first and second die stations, first transfer means for transferring new workpieces to the first die station and second transfer means for transferring partially formed workpieces ejected from the first die station to the second die station, a tool carrier mounted on the slide and pivotable thereon in a plane perpendicular to the direction of slide movement, said tool carrier being adapted to support each of a pair of tools in alignment with a separate one of said die stations when in one working position and each of a separate pair of tools each in alignment with a separate one of said die stations when in the other working position, said ejecting means and said first and second transfer means being constructed and arranged to operate, in timed relationship to movement of said slide, on a workpiece at the first die station only after two forward strokes including at least one tool working stroke of the slide subsequent to arrival of a workpiece at the first die station and on a workpiece at said second die station only after two forward strokes including at least one tool working stroke of the slide subsequent to arrival of such workpiece at said second die station, the number of working strokes at either of said die stations being altered between one or two by providing a corresponding number of one or two tools on the carrier for cooperation with a particular die station without requiring change of the timed relationship of both of said transfer and said ejecting means with said slide.

14. A metal forming machine as set forth in claim 13, wherein said ejecting means is constructed and arranged to perform a trim operation at said second die station, and cam means operative on said ejection means to displace said ejection means for said trim operation, said cam means being reversible between two alternative positions, one of said alternative positions developing trim displacement of said ejection means at the first tool working stroke of said slide at said second die station and the other of said reversible positions developing trim displacement of said ejection means at the second tool working stroke of said slide at said second die station.

* * * * *